United States Patent [19]

Peets

[11] 4,062,606

[45] Dec. 13, 1977

[54] CONVERTIBLE SEWING MACHINE CABINETS

[75] Inventor: Robert Seymour Peets, Watchung, N.J.

[73] Assignee: The Singer Company, New York, N.Y.

[21] Appl. No.: 715,100

[22] Filed: Aug. 17, 1976

[51] Int. Cl.[2] ..... A47B 83/00; A47B 21/00; A47B 81/00

[52] U.S. Cl. ..... 312/237; 312/21; 312/208

[58] Field of Search ..... 312/21, 314, 317, 237, 312/278, 208; 108/63; 112/217.1

[56] References Cited

U.S. PATENT DOCUMENTS

| | | | |
|---|---|---|---|
| 398,095 | 2/1889 | Thompson | 312/21 |
| 502,597 | 8/1893 | Voos | 108/63 |
| 2,103,091 | 12/1937 | Robert | 312/317 R |
| 2,168,813 | 8/1939 | Vinding | 108/63 |
| 2,883,249 | 4/1959 | Batson | 108/63 |
| 3,062,605 | 11/1962 | Cannon | 112/217.1 |
| 3,068,821 | 12/1962 | Hermanns | 112/217.4 |
| 3,253,870 | 5/1966 | Stanton et al. | 112/217.1 |
| 3,297,387 | 1/1967 | Parsons | 112/217.1 |
| 3,726,237 | 4/1973 | Devey et al. | 112/217.1 |
| 3,946,682 | 3/1976 | Cowdrey et al. | 312/21 |

FOREIGN PATENT DOCUMENTS

| | | | |
|---|---|---|---|
| 909,335 | 1946 | France | 312/314 |

*Primary Examiner*—Paul R. Gilliam
*Assistant Examiner*—Victor N. Sakran
*Attorney, Agent, or Firm*—Edward L. Bell; Robert E. Smith

[57] ABSTRACT

This disclosure relates to cabinets and in particular to a cabinet which is adapted for use in performing textile operation in combination with a sewing machine having both flat bed and cylinder bed working capabilities. The cabinet may be opened from a stored position, in which the sewing machine is stored out of sight and the cabinet then has the appearance of a styled table or cabinet, to a first position wherein the work bed of the sewing machine is contiguous with a working surface of the cabinet, to a second position wherein the work bed of the sewing machine is in an elevated position relative to the aforementioned cabinet working surface to permit cylinder bed operation on the sewing machine and to a third position wherein a cutting board work area may be folded out from the cabinet to an elevation for permitting an operator to perform cutting operations on a material while in an operator standing position.

10 Claims, 5 Drawing Figures

CONVERTIBLE SEWING MACHINE CABINETS

BACKGROUND OF THE INVENTION

This invention relates to the field of cabinets for use in textile operations and more particularly to cabinets which are convertible to positions for both flat bed and cylinder bed sewing operations and further provides the cutting board area for material cutting or other operations.

It is known in the prior art to provide convertible sewing machine cabinets which have the capability of performing both flat bed and cylinder bed operations. For example, U.S. Pat. No. 3,946,682 issued Mar. 30, 1976 to the same assignee as the present invention discloses such a cabinet. It is also known in the art to provide work tables having collapsible working areas on which cutting operations may be performed such as shown in U.S. Pat. No. 2,883,249 issued Apr. 21, 1959 to the same assignee as the present invention. However, it is not known in the prior art to provide a cabinet having all of the aforementioned capabilities in one cabinet and in which the work areas and the sewing machine can be stored to a position in which the cabinet would then give the appearance of a styled table or cabinet.

GENERAL DESCRIPTION OF THE INVENTION

It is a purpose of the present invention to provide a novel and improved sewing machine cabinet in which a sewing machine may be stored within the cabinet and may be elevated to a first working position wherein the work bed surface of the sewing machine is contiguous with the surface of the cabinet upon which the sewing operation is to be performed. A second position is provided wherein the work bed of the sewing machine is in a position elevated above the working surface of the cabinet such that the machine may be used for cylinder bed or free arm operation. It is additionally a feature of the invention to provide a fold-away work table area which may be elevated from the rear portion of the cabinet to a position wherein an operator may perform cutting operations on a material at an elevation which may be termed a standing position elevation. Thus a three position working area is provided by the novel cabinet of the invention in order to permit the operator to perform all operations on the material in making a garment or the like at one location.

DESCRIPTION OF THE DRAWINGS

The subject invention will be best understood by referring to the accompanying drawings in which.

DETAILED DESCRIPTION OF THE INVENTION

Figure 1:
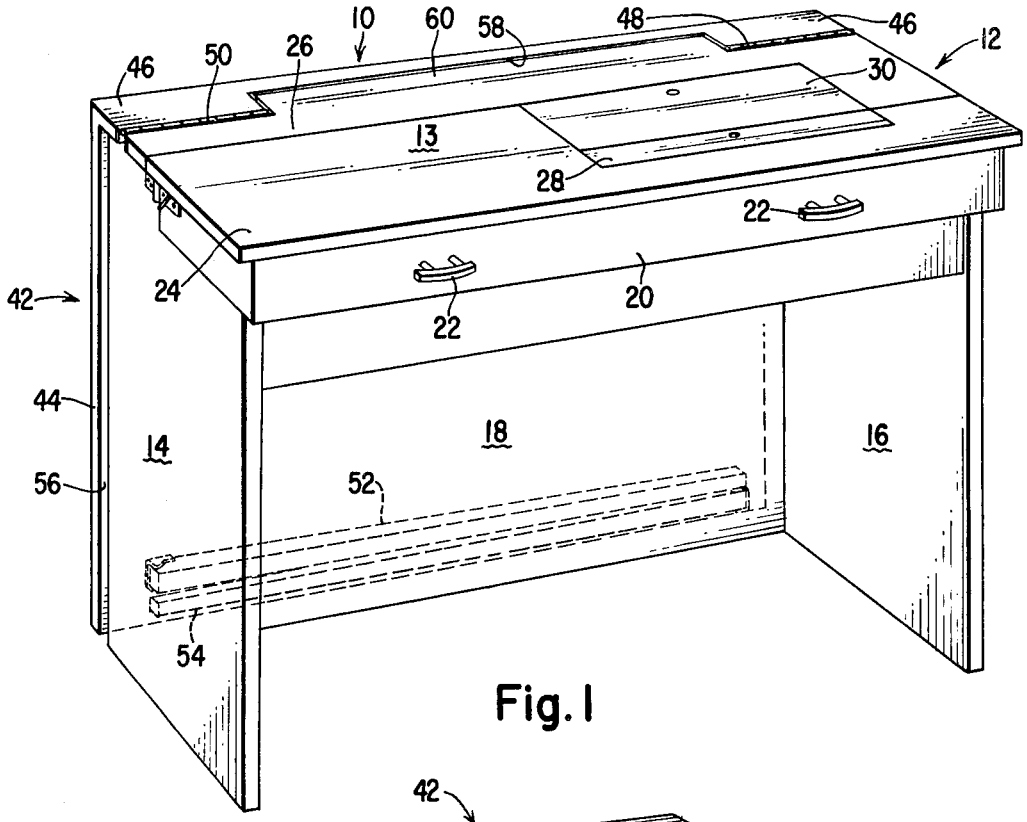
FIG. 1 is a perspective view of the cabinet of the invention in the folded or stored position.
Figure 2:
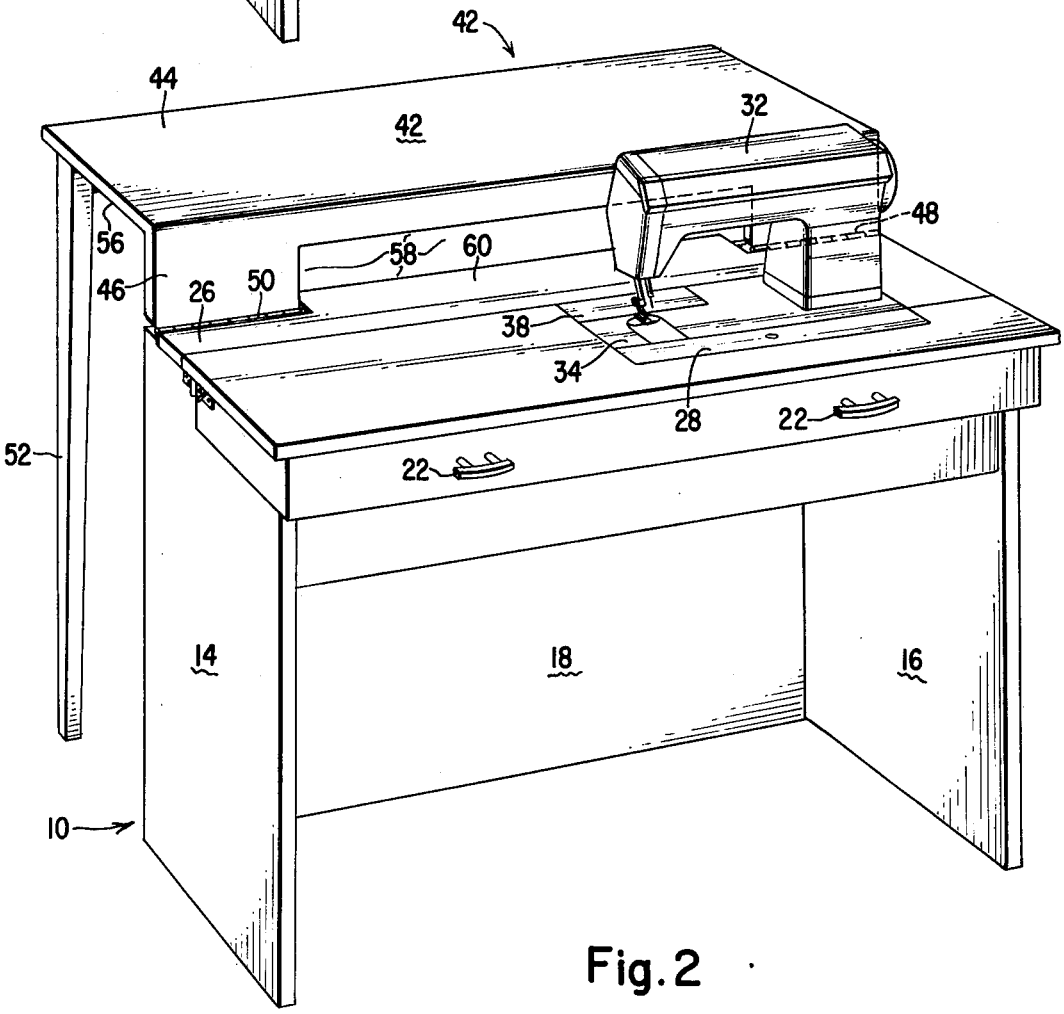
FIG. 2 is a perspective view of the cabinet of the invention with the sewing machine in the flat bed working position and with the cutting table in the elevated position.

Referring to the drawings there is shown in FIG. 1, a cabinet 10 adapted for storing a sewing machine within the interior thereof such that such sewing machine is out of sight when in the stored position. The cabinet 10 includes a top panel 12 providing a working surface 13, side panels 14 and 16 and a rear panel 18. Depending from the top panel 12 is a front portion 20 having handles 22 fixed thereto. The top panel 12 is comprised of a top front portion 24 and a rear T-shaped portion 26. The top front portion 24 has a cutout in which is disposed two hinged panels 28 and 30. The hinged panels 28 and 30 are operative for folding down within the cabinet to permit a sewing machine 32 to be raised into an operative position as for example shown in FIGS. 2, 3 and 4. When in the position shown in FIG. 1, the sewing machine is disposed within the cabinet and the hinged panels are raised such that their tops are contiguous with the top panels 24 to form a smooth table top surface. When the panels 28 and 30 are manuevered so as to raise the sewing machine to the position shown in FIG. 2, the rear top hinge panel 30 is folded within the cabinet and the sewing machine bed surface 34 is contiguous with the top surface of the front hinge panel 28 so as to provide a flat bed sewing surface. As described in U.S. Pat. No. 3,946,682, the entire front panel 24 may be shifted to the left as viewed in FIG. 3 and 4 where upon due to the mechanism contained within the cabinet the entire front panel 24 including the front portion 20 is dropped to a lower level so as to expose the cylinder bed portion 36 of the sewing machine for cylinder bed sewing. At the same time a hinge panel 38 on the sewing machine bed is folded down so as to completely expose the cylinder bed portion for free arm or cylinder bed sewing operation. Reference maybe made to said U.S. Pat. No. 3,946,682 for a complete description of the shifting mechanism contained within the cabinet for the top front portion 20 and 24 and the operation of the sewing machine for placing the sewing machine in the various sewing positions. In general, the sewing machine is fixedly supported on a panel 40 (FIG. 4) which is pivotally mounted to the undersurface of the cabinet top 12 so as to be pivoted from within the interior of the cabinet to a raised an operative position. When carrying out this function, the top hinge panel 30 is folded down and the sewing machine with its supporting platform 40, if pivoted up to expose the sewing machine when placed in the flat bed sewing position, mates with the hinged panel 28 and may be secured thereto by means of a latch or the like.

Figure 3:
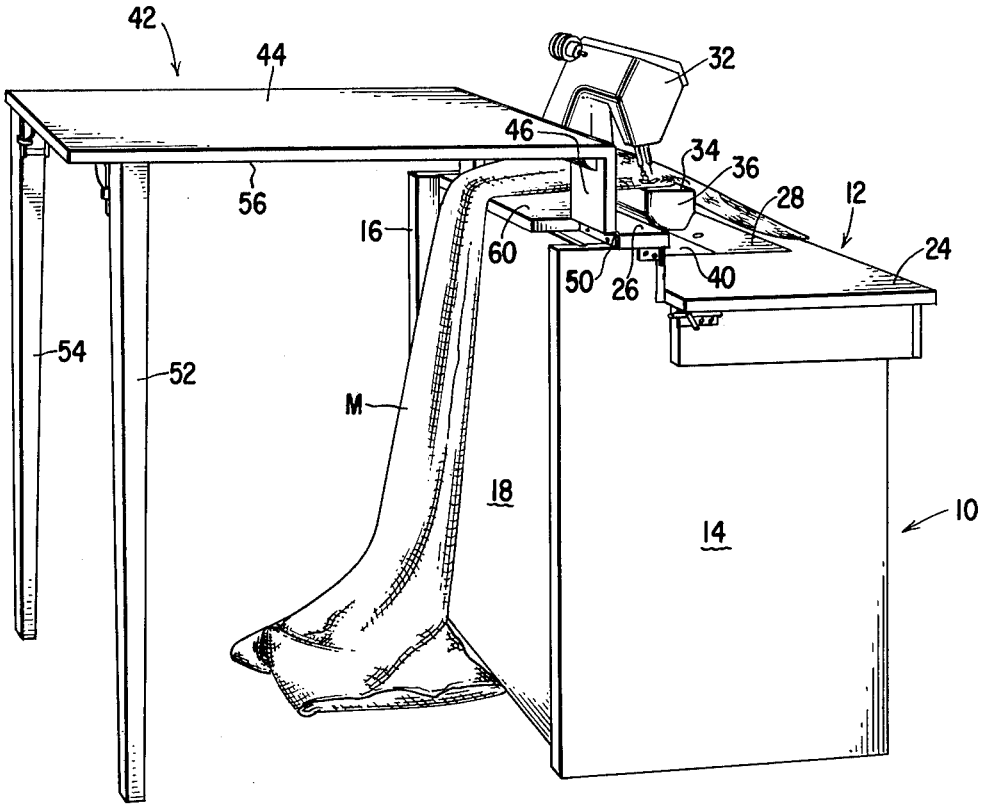
FIG. 3 is a rear perspective view of the cabinet of the invention with the sewing machine in the cylinder bed position and the work table in the elevated position.
Figure 5:
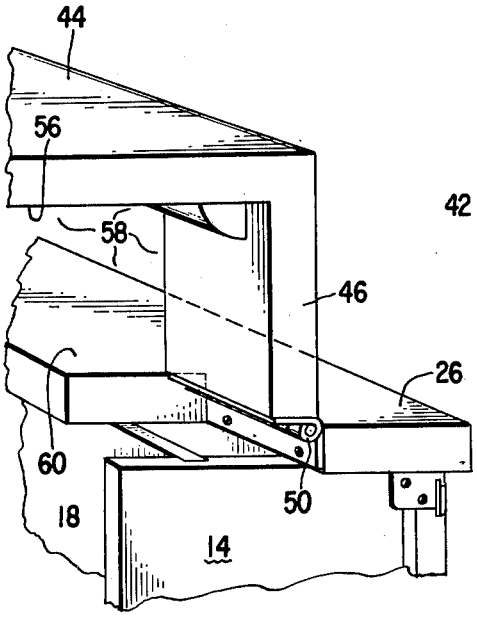
FIG. 5 is an enlarged partial perspective view illustrating the hinge arrangement for permitting folding of the cutting table.
Figure 4:
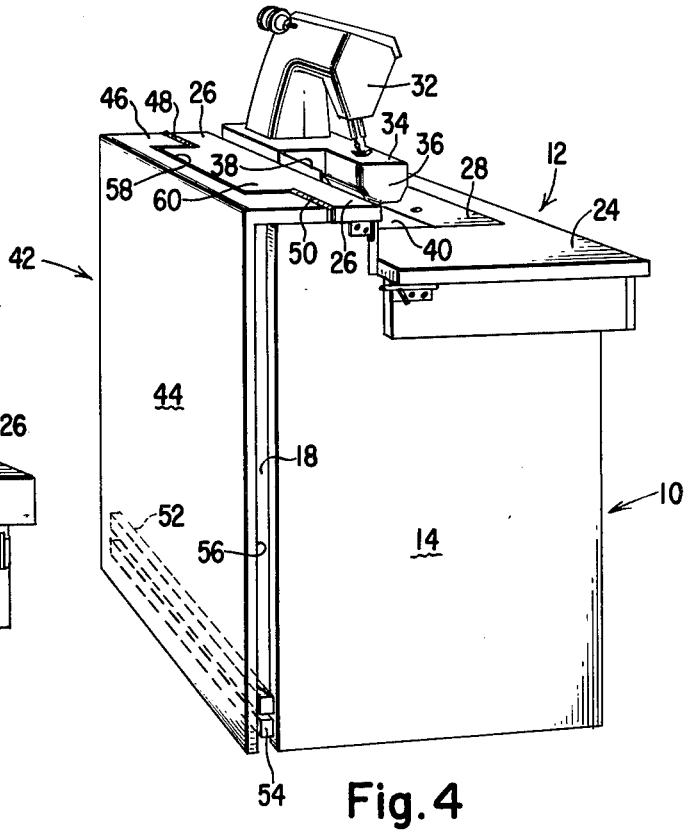
FIG. 4 is a side perspective view of the cabinet of the invention showing the sewing machine in the cylinder bed position and with the cutting table in the folded position.

As mentioned above, when converting the cabinet to the cylinder bed sewing position, the front portion 24 of the top 12 if shifted to the left where upon due to a hinged relationship with the supporting walls of the cabinet the front portion 24 also is lowered as illustrated in FIGS. 3 and 4. The front portion 24 may be latched into this position and held therein by a suitable latch or the like. Again, reference should be made to U.S. Pat. No. 3,946,682 issued Mar. 30, 1976 and assigned to the same assignee as the present application for a more detailed description of a specific type mechanism for shifting the cabinet in a sewing machine between the various positions described above.

Further in accordance with the present invention, as mentioned above, the rear portion 26 of the top 12 is substantially T-shaped with cutout portions being disposed at each end thereof at the side facing the rear of the cabinet. A substantially L-shaped panel 42 including panel portion 44 and integral panel portion 46 at right angles thereto is connected to the rear panel portion 26 of the top 12 by means of hinges 48 and 50. As best shown in FIGS. 1 and 4, the panel portion 44, when in the folded position, extends downwardly and across the rear of the cabinet 10 to form a back surface thereof. A pair of foldable legs 52 and 54 depend from the undersurface 56 of the panel 44 and may be folded out to support the panel 44 in a raised position as illustrated in FIG. 3 or folded against the undersurface 56 of the panel portion 44 to a stored position as illustrated in FIGS. 1 and 4. The legs 52 and 54 may be connected to the panel 44 by any suitable folding hinge structure which will permit the legs to be locked when in the elevated position.

When making a garment or the like, it is a usual practice to cut the material to be made into the garment from a pattern or the like prior to the sewing operation. Very often this operation as well as the other preparation and finishing operations are carried out on a separate table surface away from the sewing area and the cut pattern which is very often temporarily held together by pins or the like must be transported from the cutting area to the sewing area. It is a purpose of the present invention to provide a complete textile preparation, sewing, and finishing area so that all operations in manufacturing a garment or the like may be performed in one area. Thus, when an operator desires to make a garment, the L-shaped panel 42 may be raised to the position shown in FIGS. 2 and 3 with the legs 52 and 54 folded out to support the same for performing the cutting operation or the like. The top surface of the panel portion 44 is constructed so as to permit the operator to cut the material thereon and has a height which is convenient for cutting the material while in a standing position. For this reason, when the panel is raised to the cutting position the panel portion 46 forms legs to raise the height of the panel portion 44 above the top surface of the rear portion 26 of the cabinet sufficient to enable the operator to cut the material or perform other operations on the surface of the portion 44 while in a standing position. When the cutting surface area is no longer desired to be used, and it may be lowered to the folded position illustrated in FIGS. 1 and 4. It will be seen that the panel portion 46 has a top surface which becomes contiguous with the rear panel portion 26 of the cabinet 10 when in the folded position.

After the material is cut on the panel portion 44 or prepared by some other means for the sewing operation, the operator will then transport the material to the sewing area which is disposed at a height convenient for the operator to sit and operate the sewing machine. It will be further seen that the panel portion 46 of the cutting board area has a cutout 58 in the panel portion 46 which, when the cutting board is in the raised or operative position, provides an opening for the material M to pass through during feeding through the sewing machine. (See FIG. 3). Thus, the operator may sit at the sewing machine and carry out the sewing operation without any interference of the feeding of the material from the cutting table portion of the cabinet. When the cutting board portion of the cabinet is lowered to the stored position the opening 58 mates with a leg portion 60 of the T-shaped rear panel portion of the top 12 so as to form a substantially continguous surface. Therefore, the operator may operate the sewing machine with the cutting board area in the stored position without any interference of the feeding of the material across the bed 34 of the sewing machine and the top surface of the cabinet.

From the above description it will be seen that a novel sewing machine cabinet combination is provided in which substantially all operations for the making of a garment can be performed. The cabinet provides for storage facilities for the sewing machine when not in use, sewing positions for flat bed and cylinder bed sewing and a cutting board or work area which is convenient for performing operations by the operator while in a standing position and which can be folded to a stored position when not in use. While the invention has been described in its specific perferred embodiment it will be obvious to those skilled in the art that various modifications can be made without departing from the spirit and scope of the invention as set forth in the appended claims.

Having thus described the nature of the invention what is claimed is:

1. A cabinet for performing textile operations and for carrying a sewing machine having a work supporting bed and an arm overhanging said bed including reciprocable needle means for penetrating work supported on said bed, said bed including conversion means for converting said bed between a flat bed work supporting surface and a cylinder bed work supporting surface such that said sewing machine may be used in a flat bed sewing mode and a cylinder bed sewing mode, said cabinet comprising a first top work table portion, a side support means at each lateral side of said cabinet and disposed for supporting said first top work table portion, said first top work table portion including first and second laterally elongate work table portions, said first laterally elongate portion including a cut-out portion therein for receiving a sewing machine for movement between a stored position within said cabinet and elevated sewing positions wherein said sewing machine cooperates with the surface of said first and second laterally elongate work table portions, and means for supporting said sewing machine for relative movement with said first laterally elongate portion between a first position wherein the work supporting bed of said sewing machine is contiguous with the surface of said first laterally elongate portion for operation of said sewing machine in the flat bed sewing mode and a second position wherein the work supporting bed of said sewing machine is elevated above the surface of said first laterally elongate portion for operation of said sewing machine in the cylinder bed sewing mode, and a third laterally elongate top work table portion carried by said cabinet, said third laterally elongate portion being pivotally supported on said cabinet for movement between a folded stored position and an elevated working position, and said third laterally elongate portion when in an elevated working position extending from said cabinet and being at a height different from said first and second laterally elongate portion.

2. A cabinet as recited in claim 1 wherein said third laterally elongate portion when in an elevated working position is disposed at a height convenient for an operator to use the surface of said third laterally elongate portion while in a standing position.

3. A cabinet as recited in claim 1 wherein said third laterally elongate portion is substantially L-shaped and one leg thereof when in the elevated position extending substantially perpendicular and in an upward direction and the other leg thereof extending parallel to said first and second laterally elongate portions.

4. A cabinet as recited in claim 3 wherein said one leg of said third laterally elongate portion when said third laterally elongate portion is in a folded position extending parallel to and having its top surface contiguous with said first and second laterally elongate portions.

5. A cabinet as recited in claim 3 wherein said one leg is provided with a cut-out portion such that when in the elevated position work may pass freely from said sewing machine through said cut-out portion.

6. A cabinet as recited in claim 1 wherein said third laterally elongate portion is substantially L-shaped with one leg thereof being pivotally connected to said second laterally elongated portion.

7. A cabinet as recited in claim 1 wherein said third laterally elongate portion includes foldable leg means for supporting said third laterally elongate portion in an elevated position and disposed for folding relationship therewith when in a folded stored position.

8. A cabinet for performing textile operations and for supporting a sewing machine in a stored position, a flat bed sewing position and a cylinder bed sewing position, said cabinet comprising a top panel portion supported on said cabinet at an elevation for permitting sewing operations in an operator sitting position, said top panel portion including a first laterally elongate panel section having a cut-out portion for receiving a sewing machine while in the stored, flat bed and cylinder bed positions and including moveable panel members operable for covering said cut-out portion to form a contiguous surface with the surface of said first panel section when the sewing machine is in the stored position and for permitting the sewing machine to be raised from the stored position to an operative position, said first panel section and said sewing machine being relatively moveable between a flat bed sewing position and a cylinder bed position, a second laterally elongate panel section disposed in cooperative relationship with said first panel section to form a contiguous surface with said first panel section at least when the sewing machine is in stored position, and a third laterally elongate panel section operably connected to said second panel section for movement between a raised position and a stored position, said third panel section including means for elevating said third panel section to a height higher than said first and second panel sections when in the raised position and for forming a contiguous surface with said second panel section when in the stored position.

9. A cabinet as recited in claim 8 wherein said third panel section is L-shaped with one leg thereof being operative to raise said third panel section to a elevation higher than said first and second panel sections when said third panel section is in the raised position and to form a contiguous surface with said second panel section when in the stored position.

10. A cabinet as recited in claim 9 wherein said third panel section is pivotally connected to said second panel section for pivoting said third panel section between a raised and stored position and the other leg of said third panel section forming a rear wall surface of said cabinet when in the stored position.

* * * * *